US005664869A

United States Patent [19]

Bitton

[11] Patent Number: 5,664,869

[45] Date of Patent: Sep. 9, 1997

[54] LOW VOLTAGE POTLAMP SYSTEM

[76] Inventor: Jacques Bitton, 27 Brookmill Drive, Thornhill, Ont., Canada, L4J 6K6

[21] Appl. No.: 601,548

[22] Filed: Feb. 14, 1996

[51] Int. Cl.[6] ..... F21S 1/02

[52] U.S. Cl. ..... 362/147; 362/364; 362/294

[58] Field of Search ..... 362/147, 364, 362/365, 404, 294; 174/50, 58, 66, 67

[56] References Cited

U.S. PATENT DOCUMENTS

| | | | |
|---|---|---|---|
| 2,863,990 | 12/1958 | Wince | 362/365 |
| 3,091,687 | 5/1963 | Papsdorf | 174/66 |
| 3,286,090 | 11/1966 | Brown | 362/364 |
| 4,403,277 | 9/1983 | Eargle, Jr. et al. | 174/50 |
| 4,459,648 | 7/1984 | Ullman | 362/365 |
| 4,733,339 | 3/1988 | Kelsall | 362/365 |

*Primary Examiner*—Y. My Quach
*Attorney, Agent, or Firm*—D. W. Eggins

[57] ABSTRACT

The installation of reduced diameter potlamps for use with high intensity halogen bulbs is greatly facilitated by using a connector box having the step-down transformer mounted upon one end of the box, and connecting with and spaced from the lamp pot by way of a rigid wiring channel that serves as a spacer bridge. This type of lighting is generally installed in upwardly recessed relation in a dropped ceiling having small diameter apertures in its surface within which the pot lights are inserted. The connector box and its transformer are dimensioned to be inserted upwardly through the restricted aperture into which the small diameter pot of the halogen light is fitted. The connector box has removable side doors for maximum access to the interior of the box, and knock-outs on the top and bottom sides and on the free end, for optimum convenience in making circuit connections thereto. A drop-leg spacer maintains the assembly in upwardly spaced relation from the inner surface of the dropped ceiling.

8 Claims, 4 Drawing Sheets

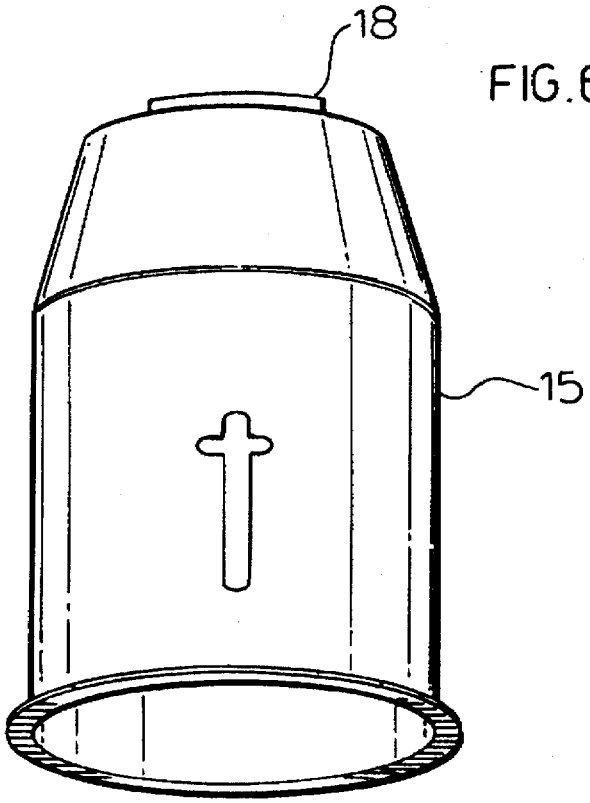
FIG. 6.
FIG. 7.
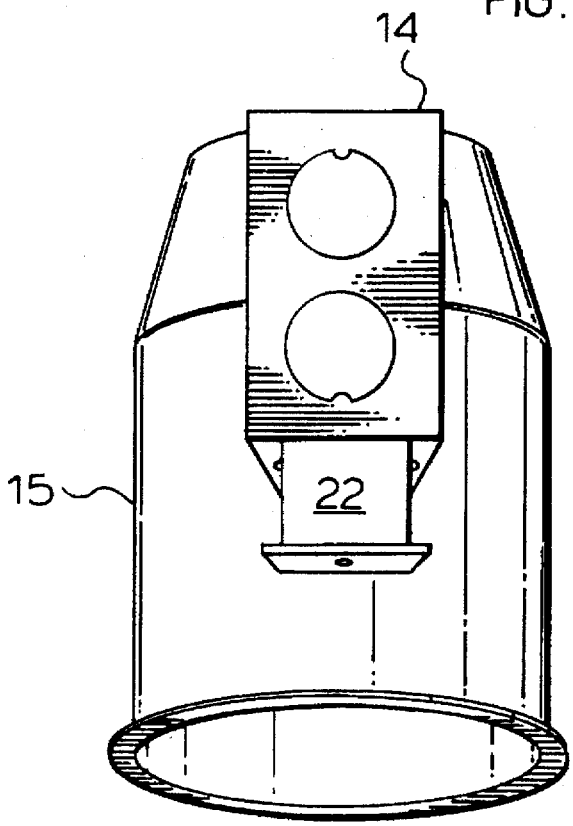

LOW VOLTAGE POTLAMP SYSTEM

FIELD OF THE INVENTION

This invention is directed to a pot light in combination with a connector box having a transformer mounted upon the end thereof, and secured to the pot light by a spacer bridge; and in particular to the combination wherein the pot light incorporates a low voltage, high intensity halogen bulb, and the connector box has openable side portions to facilitate electrical connection thereto.

BACKGROUND TO THE INVENTION

Pot light have been in use for many years, being particularly useful in location having dropped or suspended ceilings, where the pot portion of the installation is readily set into the ceiling, and the wiring provisions are readily arranged and connected above the ceiling.

The usual type of incandescent bulb, with its spherical glass globe is normally accomodated in a pot of some four and a half to six inches in diameter, the pot diameter being such as to permit ready insertion of the hand of an installer through the ceiling aperture, in carrying out the installation.

However, the advent of high intensity halogen light has introduced a number of problems, mainly associated with the high heat concentration associated with these lights, their small size and their low voltage requirements, which require the provision of a step-down transformer.

SUMMARY OF THE INVENTION

The present invention provides in combination a low voltage, high intensity pot light and transformer combination, having a light pot of predetermined small diameter for insertion into a ceiling surface having a corresponding aperture to receive the pot in inserted, fitting relation therein; a connector box to receive a wiring connection therein, having door means to access the interior of the box; electrical transformer means mounted upon one end of the box exterior; and bridge means connecting the box and transformer in spaced relation from the pot, the transverse dimensions of the box and transformer being restricted to permit introduction of the box and transformer into a limited access space by way of said ceiling aperture.

The present box is of predetermined minimum size, being subject to certain minimum volumetric requirements imposed by safety standard regulations.

In a preferred embodiment the transformer has lateral dimensions closely related to the corresponding lateral dimensions of the connector box, the transformer being shallower than the box so as to fit below the bridge means.

A drop-leg spacer may be used to assist in locating the box and attached transformer clear from the upper surface of the ceiling. With the bridge secured to the top of the pot, the pot, when installed in upwardly inserted relation in a false or dropped ceiling serves to locate the box in substantially horizontally positioned, supported relation above the ceiling top surface.

This facilitates the circulation of air in cooling relation about the transformer and the box.

The transformer serves as a radiation barrier for the box, so as to provide a shield from the radiant heat emitted by the high intensity pot light.

The bridge also provides a thermal gradient, to moderate the transfer of heat by conduction to the connector box.

The transformer may be provided with an access end cap located on the end thereof remote from the connector box, to facilitate assembly. This cap also moderates the thermal transfer conditions from the lamp pot relative to the transformer, the box and its contents.

The use of a connector box carrying a spatially compatible transformer mounted thereon, and connected by way of a bridge extending normally from the polar axis of the pot lamp greatly facilitates the upward insertion and location of the lamp connector box and associated transformer, and greatly simplifies it subsequent connection to the electrical circuit.

BRIEF DESCRIPTION OF THE DRAWINGS

Certain embodiments of the invention are described, by way of illustration, without limitation of the invention thereto other than as defined in the present claims, reference being made to the accompanying drawings, wherein:

FIG. 6 is an assembly end elevation, from the lamp end; and

FIG. 7 is an assembly end elevation, from the box end.

DETAILED DESCRIPTION OF THE INVENTION

Figure 1:
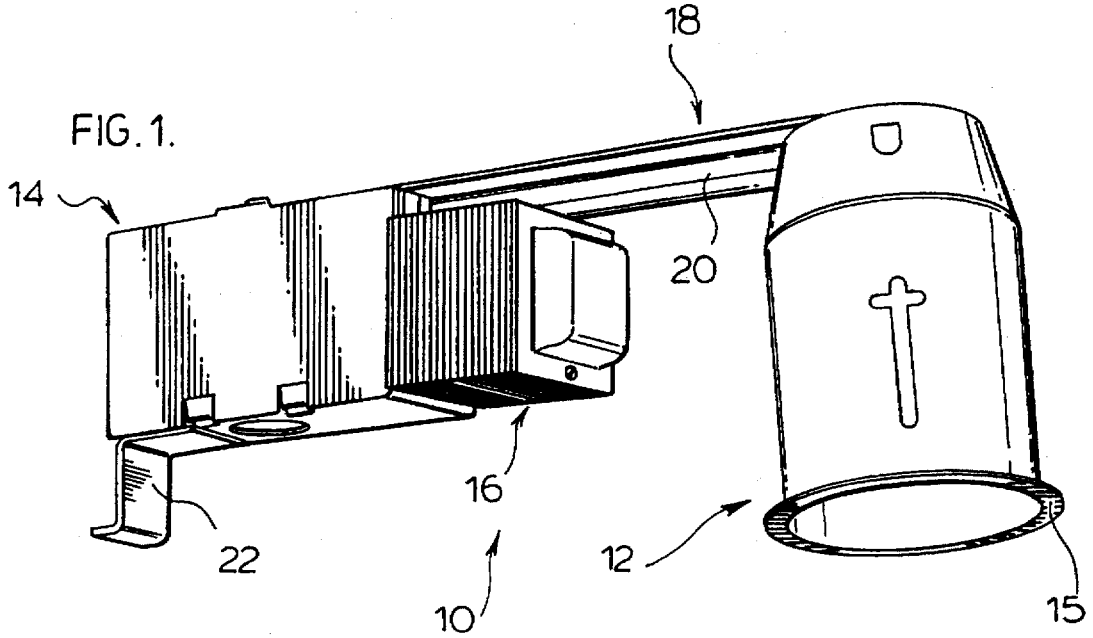
FIG. 1 is a perspective view in side elevation of the pot light, connector box and transformer, in assembled relation.

Referring to FIG. 1, the combined pot light installation 10 comprises a light pot 12, containing a bulb socket and halogen bulb (not shown). A connector box 14 has an electrical step-down transformer 16 with a 12-volt output mounted upon the box end located adjacent the pot 12.

A bridge 18 connects the box 14 in predetermined spaced relation with the pot 12. The bridge 18 includes an extended tongue portion 19 (see FIG. 2) of the connector box 14, and an inverted conduit 20, of C-section, in which is carried the wires (not shown) that provide low-voltage current to the halogen light fixture within the pot.

Figure 3:
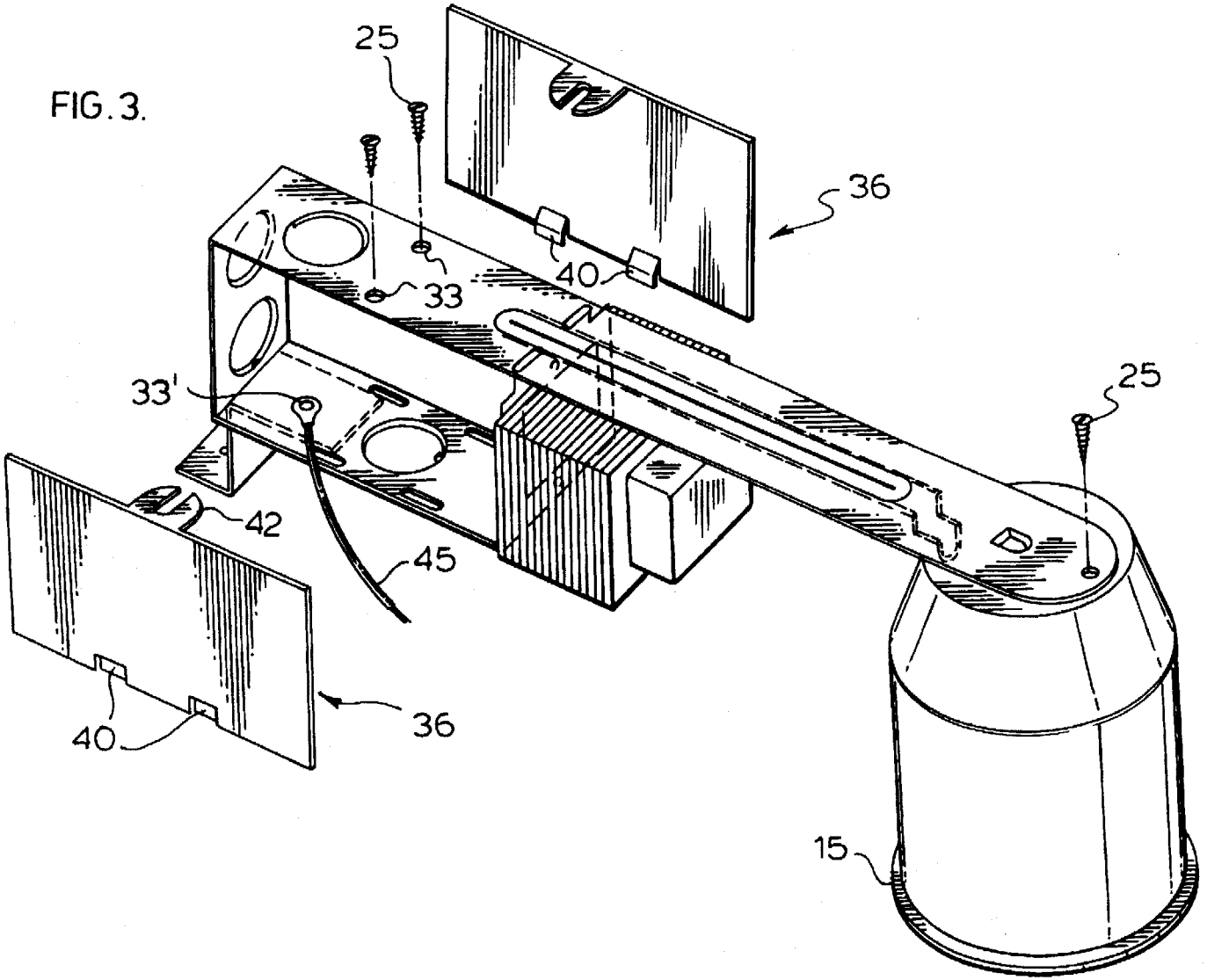
FIG. 3 is a schematic perspective from above, with the two side doors of the box in off-set, disassembled relation.

The remote end of the bridge 18 has a punched-out depending tongue portion 21 and a retainer aperture 23 for a retaining rivet or screw 25 (see FIG. 3).

The transformer 16 is mounted upon one end of the box 14.

At the other end of the box 14 a drop leg 22 is secured, in use to located the box 14 and transformer 16 in spaced relation above the upper surface of the ceiling, beneath and against which the flange 15 of pot 14 is located.

Figure 2:
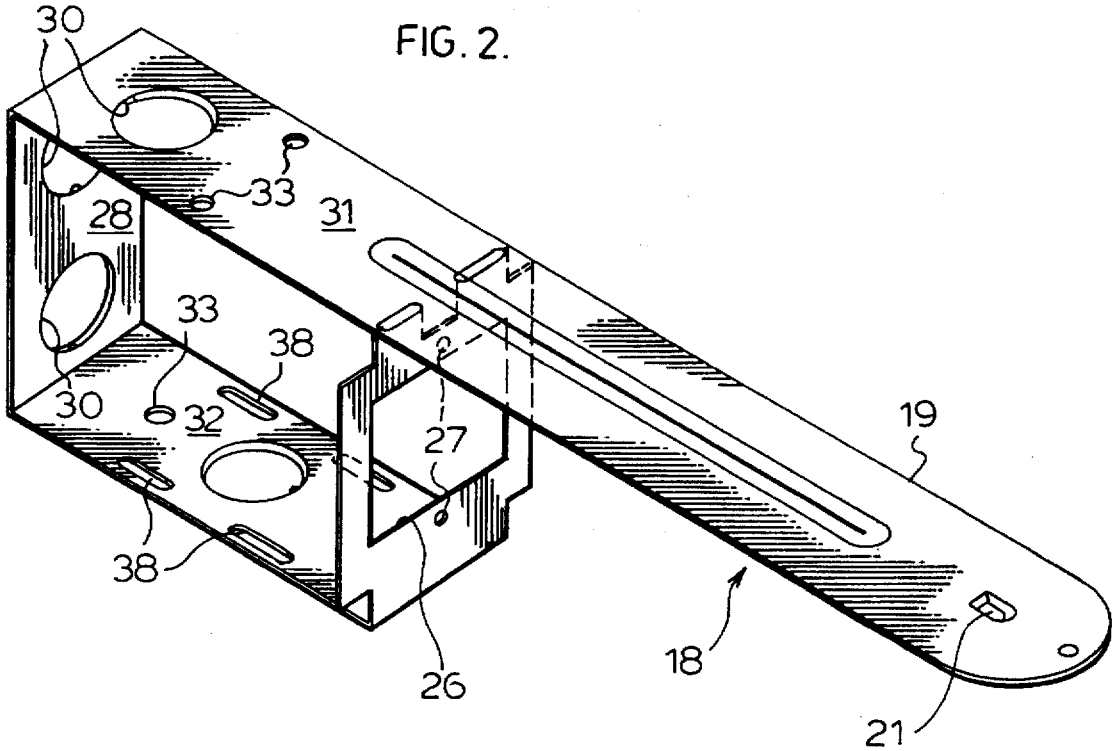
FIG. 2 is a schematic view, in perspective, looking down upon the bridge and box assembly, the box sides being removed.

Referring further to FIG. 2, the box 14 has a square aperture 26 for the transformer 16, with adjacent bolt holes 27 for the transformer securing bolts. The opposite end 28 of box 14 has a pair of conduit apertures 30 by which wiring entry clamps (not shown) may be secured.

The top side 31 and bottom side 32 each contain a single conduit connection aperture 30. Tapped screw holes 33 in the top side 31 receive retaining screws 25 by which the side doors 36 (see FIG. 3) are secured to the box 14.

In the bottom side 32 a pop rivet 33' secures the drop leg 22 beneath the box 14, and also secures a ground wire 45 to the interior of the box 14.

The bottom side 32 has four slots 38, to receive the hinge tabs 40 of the side doors 36 in inserted relation therein. Each side door 36 has a bifurcated latch portion 42 which extends laterally into registry with a respective hole 33, for securement thereto by way of a retaining screw 25.

Figure 4:
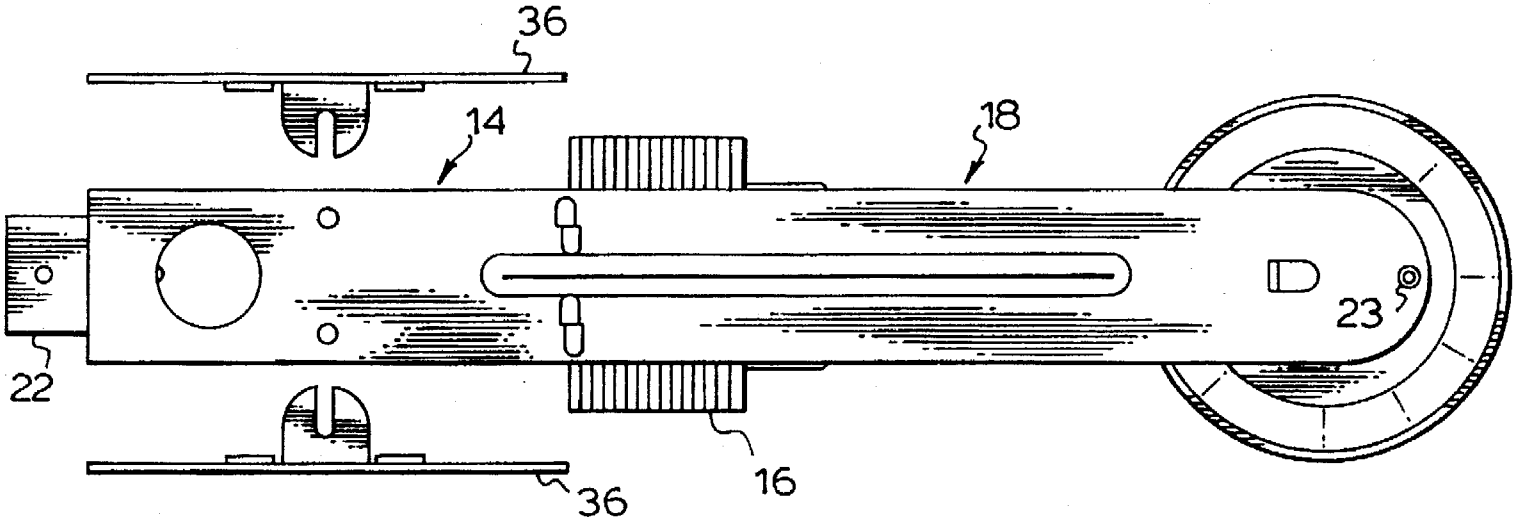
FIG. 4 is a top view, with the side doors off-set.
Figure 5:
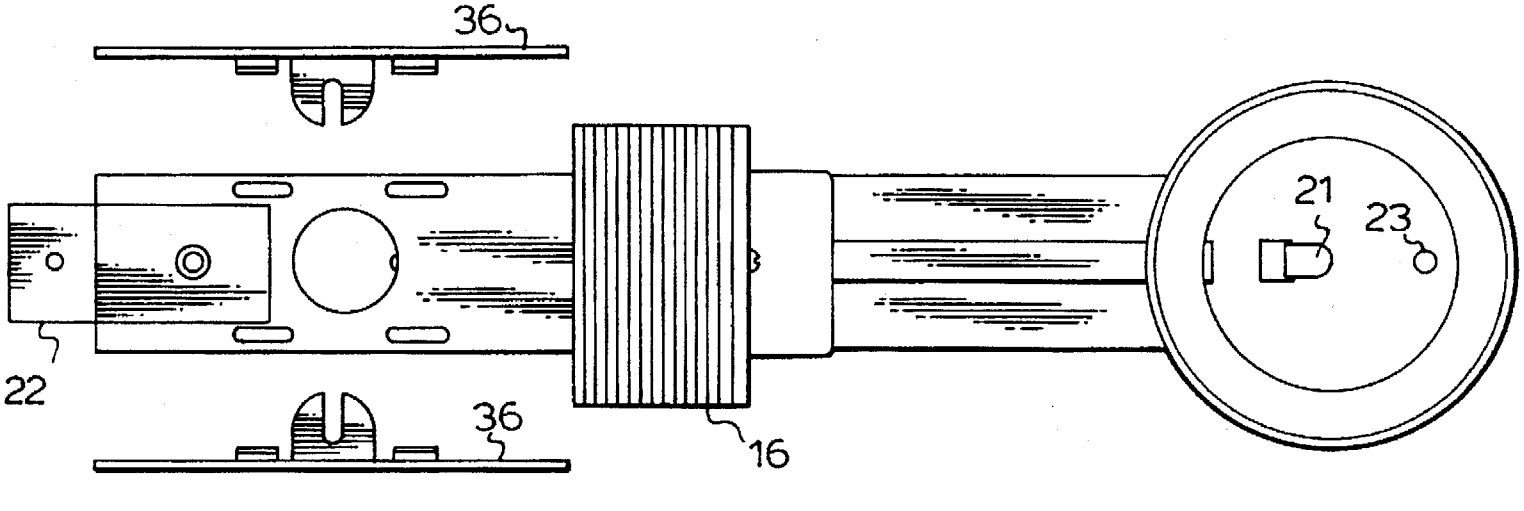
FIG. 5 is a bottom view, similar to FIG. 4.

FIGS. 4 and 5 show the box doors in dissassembled relation; and

FIGS. 6 and 7 complete the views of the assembly.

COMMERCIAL APPLICABILITY

The high efficiency and high intensity of halogen light makes their use in commercial establishments very attractive, and the present pot/connector box/transformer combination greatly simplifies installation as well as providing enhanced safety against dangerous overheating. High market acceptance is anticipated.

What I claim by Letters Patent of the United States is:

1. A low voltage, high intensity miniature pot light and connector box combination, comprising; a miniature light pot upwardly inserted in close fitting relation within a restricted ceiling aperture that substantially precludes hand access therethrough; a hollow connector box of limited rectangular cross section for passage of the box upwardly through said restricted ceiling aperture; an elongated bridge portion connecting said box to said pot light in predetermined spaced-apart relation; said pot light and connector box combination including a voltage reduction transformer mounted on one end of said box in substantially aligned relation with said connector box and located between said connector box and said pot light serving as a radiation barrier for the box, with output conductors extending from the transformer to said pot light; said box having at least one access door for accessing the interior of the box; and at least one aperture in said box receiving at least one wiring conduit in entered relation with the box.

2. The combination as set forth in claim 1, including a foot portion extending downwardly from said box in at least partial supporting relation with said box.

3. The combination as set forth in claim 1, said transformer being mounted on said box end closest said pot light, between the box and the pot light.

4. The combination as set forth in claim 3, said box having a pair of access doors in mutually opposed relation on the sides of the box.

5. The combination as set forth in claim 4, said box having at least four said apertures for receiving said at least one wiring conduit.

6. The combination as set forth in claim 1, said bridge portion including a wiring conduit locating of said output conductors in enclosed relation in the conduit.

7. The combination as set forth in claim 1, said bridge having a tongue portion engaging an apertured portion of said pot light in entered relation in the apertured portion, said bridge having a locking aperture receiving a lock screw passing through the locking aperture and the pot light.

8. The combination as set forth in claim 1, said box and said transformer being dimensioned laterally and arranged relative to said bridge and said pot light to facilitate passage of the box and transformer upwardly through said restricted ceiling aperture.

* * * * *